US006917000B2

(12) United States Patent
Yen

(10) Patent No.: US 6,917,000 B2
(45) Date of Patent: Jul. 12, 2005

(54) SIGNAL INPUT DEVICE

(75) Inventor: Chi-Yu Yen, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/628,466

(22) Filed: Jul. 29, 2003

(65) Prior Publication Data

US 2004/0140183 A1 Jul. 22, 2004

(30) Foreign Application Priority Data

Jan. 17, 2003 (TW) ..... 92200911 U
Jan. 17, 2003 (TW) ..... 92200912 U

(51) Int. Cl.[7] ..... H01H 13/70
(52) U.S. Cl. ..... 200/5 A; 200/517
(58) Field of Search ..... 200/5 R, 5 A, 200/512–514, 517, 341, 344, 345; 341/22; 345/168, 169; 400/490–496

(56) References Cited

U.S. PATENT DOCUMENTS 5,219,067 A * 6/1993 Lima et al. ..... 200/302.2
5,421,659 A * 6/1995 Liang ..... 400/472
5,430,263 A * 7/1995 English et al. ..... 200/5 A
5,810,491 A * 9/1998 Muller et al. ..... 400/496
6,156,983 A * 12/2000 Chen et al. ..... 200/302.1
6,528,742 B2 * 3/2003 Serizawa et al. ..... 200/5 R
6,573,463 B2 * 6/2003 Ono ..... 200/5 A
6,580,043 B1 * 6/2003 Spratte ..... 200/517
6,737,596 B1 * 5/2004 Hein ..... 200/310
6,765,158 B1 * 7/2004 Morrison et al. ..... 200/5 R

* cited by examiner

*Primary Examiner*—Michael A. Friedhofer
(74) *Attorney, Agent, or Firm*—Birch, Stewart, Kolasch & Birch, LLP

(57) ABSTRACT

A signal input device includes a bottom shell, a printed conducting track unit arranged on a top surface of the bottom shell, the printed conducting track unit having a plurality of contact portions, and a top cover covering the bottom shell and carrying a press unit. The press unit is aimed at and spaced above the contact portions of the printed conducting track unit for pressing by the user to connect selectively the contact portions of the printed conducting track unit.

36 Claims, 7 Drawing Sheets

SIGNAL INPUT DEVICE

BACKGROUND OF THE INVENTION

1. Field of the Invention

The present invention relates to a signal input device and, more specifically, to a signal input device in which the conducting track unit is arranged on the shell by printing, eliminating the arrangement of conducting track unit bearing means.

2. Description of the Related Art

FIG. 1 illustrates a signal input device according to the prior art, which comprises a top cover 10*a*, a set of key buttons 20*a*, a set of rubber domes 31*a*, conductive contacts 40*a*, a printed circuit board 50*a*, a membrane circuit board 60*a*, and a bottom shell 70*a*. The top cover 10*a* has a plurality of through holes 11*a*. The key buttons 20*a* are axially and movably mounted in the through holes 11*a*. The conductive contacts 40*a* are respectively mounted in the rubber domes 31*a* on the bottom side. The printed circuit board 50*a* comprises an IC chip 51*a*. The top cover 10*a*, the membrane circuit board 60*a* and the bottom shell 70*a* are fastened together in proper order. The printed circuit board 50*a* is mounted in between the top cover 10*a* and the bottom shell 70*a*, and electrically connected to the membrane circuit board 60*a*. The rubber domes 31*a* are provided between the top cover 10*a* and the membrane circuit board 60*a*. The key buttons 20*a* are respectively aimed at the rubber domes 31*a*. The conductive contacts 40*a* are respectively disposed in the rubber domes 31*a* and facing the lead wires 61*a* of the membrane circuit board 60*a*. When pressing the key buttons 20*a*, the corresponding rubber domes 31*a* are depressed to force the respective conductive contacts 40*a* into contact with the corresponding lead wires 61*a* of the membrane circuit 60*a*, thereby causing the IC chip 51*a* to output a signal.

This structure of signal input device has numerous drawbacks as follows:

1. The signal input device comprises many components, resulting in a complicated assembly process and high manufacturing cost.
2. The connection between the membrane circuit board and the printed circuit board requires a special manufacturing process, increasing the processing time of the signal input device.
3. A locating means must be provided in the top cover and bottom shell of the signal input device for the positioning of the printed circuit board and the membrane circuit board, increasing the material consumption and processing cost of the signal input device.

Therefore, it is desirable to provide a signal input device that eliminates the aforesaid drawbacks.

SUMMARY OF THE INVENTION

The present invention has been accomplished under the circumstances in view. It is the main object of the present invention to provide a signal input device, which can be modularized to facilitate the fabrication and to reduce the manufacturing cost. It is another object of the present invention to provide a signal input device, which requires fewer components, thus reducing the material cost thereof. It is still another object of the present invention to provide a signal input device, which saves processing time and cost. According to a first embodiment of the present invention, the signal input device comprises a bottom shell, a printed conducting track unit arranged on a top surface of the bottom shell, the printed conducting track unit having a plurality of contact portions, and a top cover covering the bottom shell and carrying a press unit, the press unit being aimed at and spaced above the contact portions of the printed conducting track unit for pressing by the user to connect selectively the contact portions of the printed conducting track unit. According to a second embodiment of the present invention, the signal input device comprises a bottom shell, the bottom shell having a top surface, a plurality of conductive contacts mounted on the top surface of the bottom shell, a top cover covering the bottom shell, the top cover having a bottom surface and carrying a press unit, and a printed conducting track unit located on the bottom surface of the top cover, the printed conducting track unit comprising a plurality of contact portions respectively aimed at the press unit and separated from the press unit by a distance. According to a third embodiment of the present invention, the signal input device comprises a bottom shell, the bottom shell having a top surface, a printed conducting track unit located on the top surface of the bottoms hell, the printed conducting track unit comprising a plurality of contact portions, a top cover covering the bottom shell, the top cover carrying a press unit, a plurality of rubber domes provided between the top cover and the bottom shell corresponding to the contact portions of the printed conducting track unit, and a plurality of conductive contacts respectively mounted in the rubber domes on a bottom side and facing the contact portions of the printed conducting track unit.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENT

Figure 1:
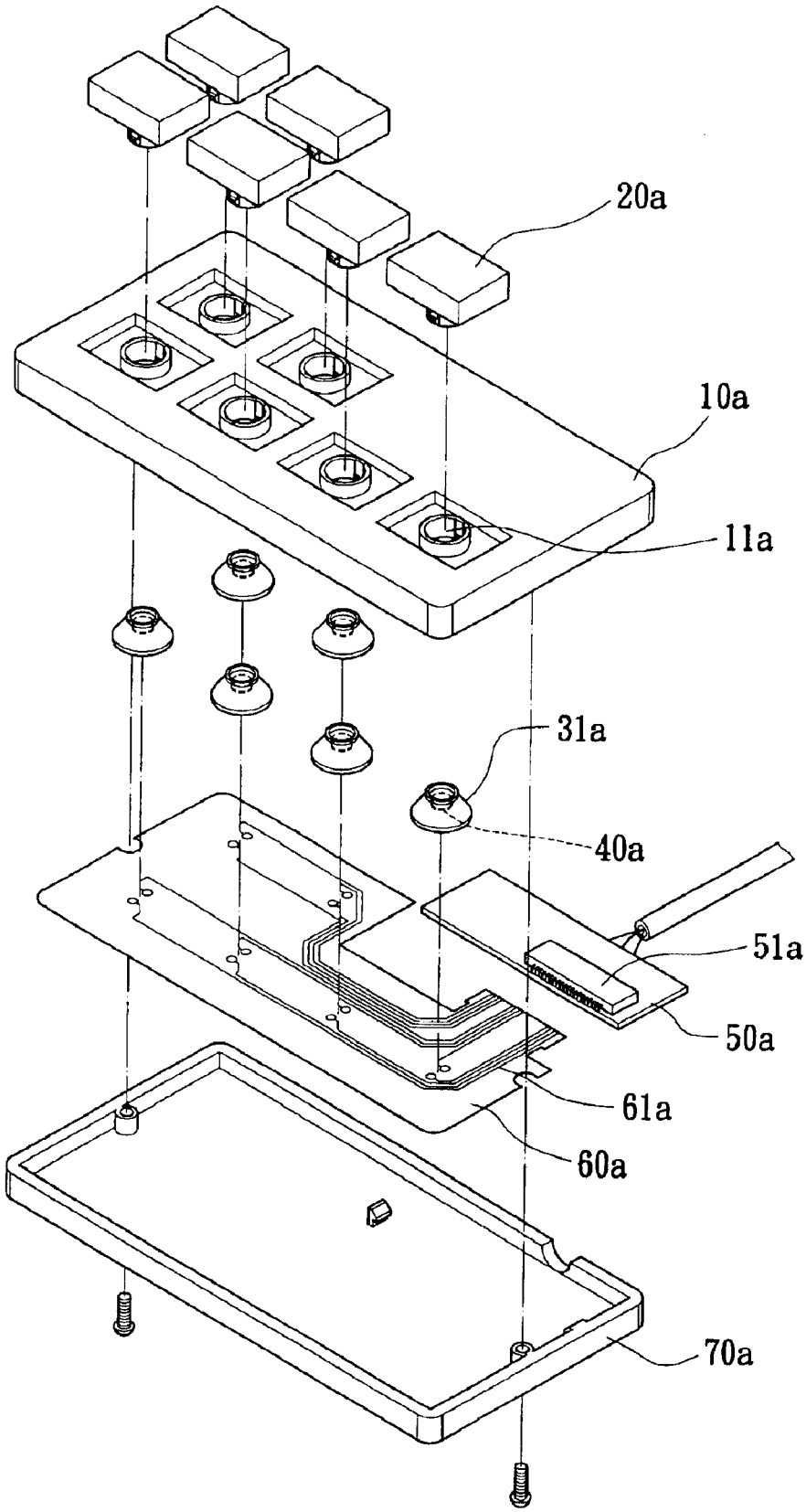
FIG. 1 is an exploded view of the prior art design.
Figure 2:
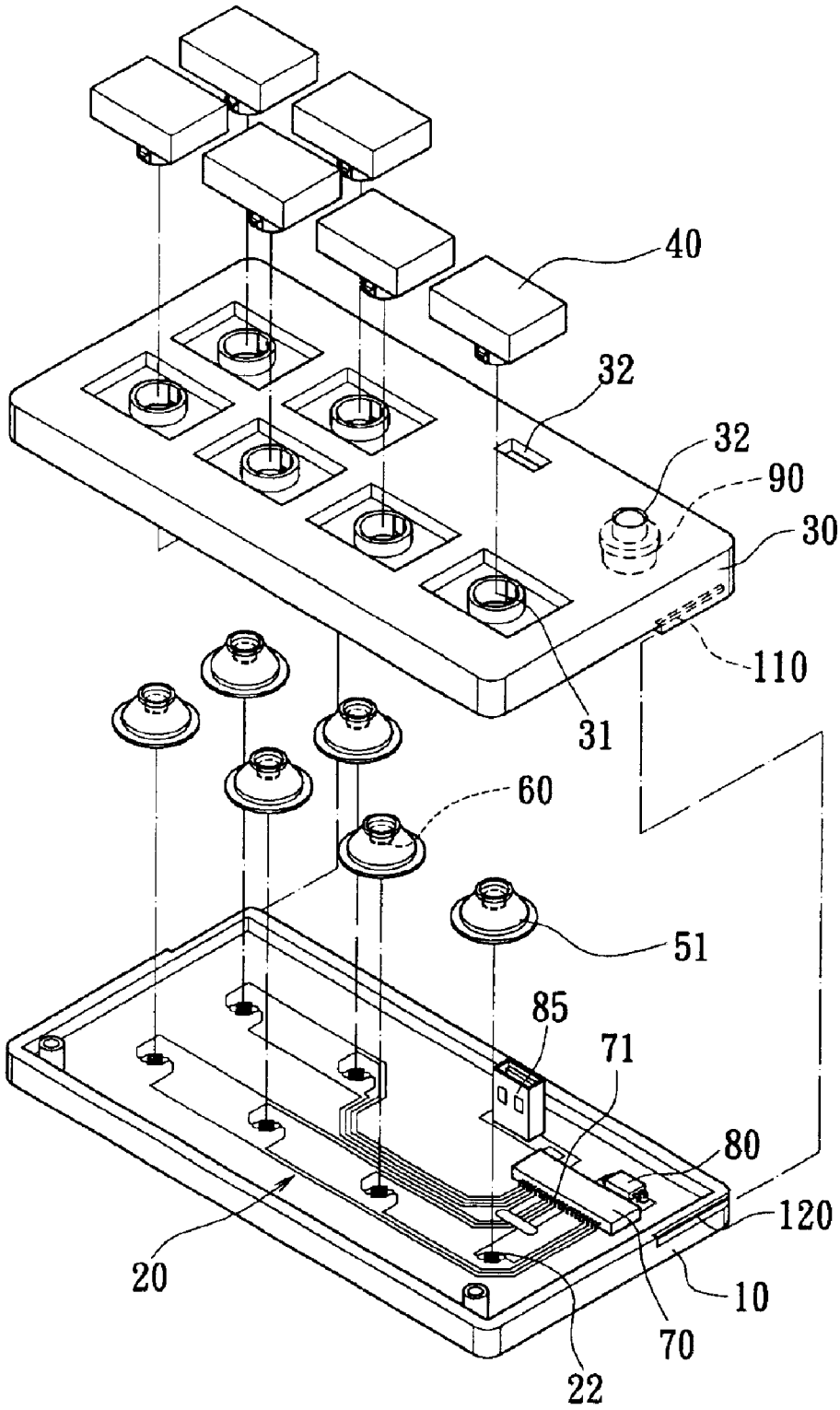
FIG. 2 is an exploded view of a first embodiment of the present invention.
Figure 3:
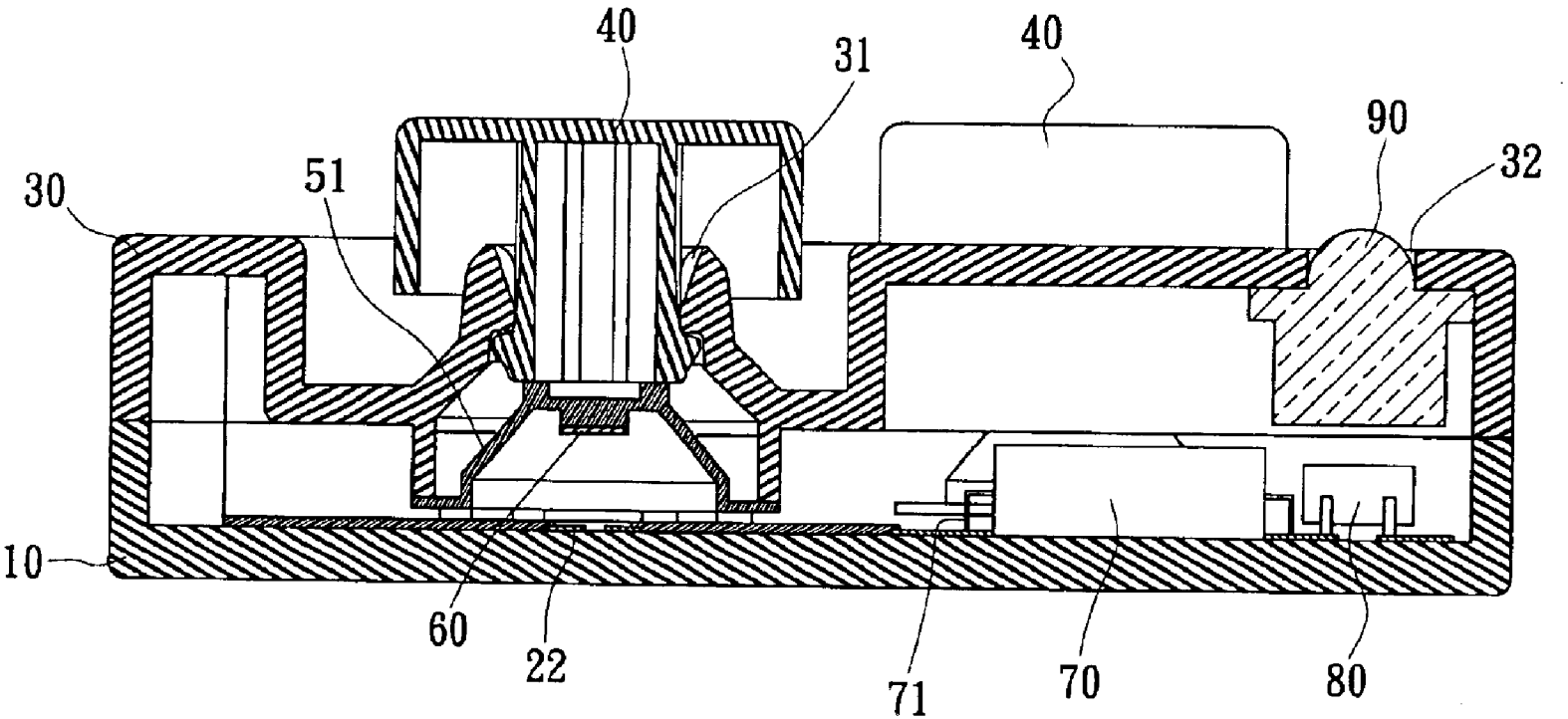
FIG. 3 is an enlarged, cross-sectional assembly view of a part of FIG. 2.

Referring to FIGS. 2 and 3, a signal input device is shown comprising a bottom shell 10, a printed conducting track unit 20, and a top cover 30. The printed conducting track unit 20 is formed on the top surface of the bottom shell 10. The top cover 30 comprises a press unit 40. Pressing the press unit 40 connects a part of the printed conducting track unit 20 to produce a corresponding input signal.

Figure 4:
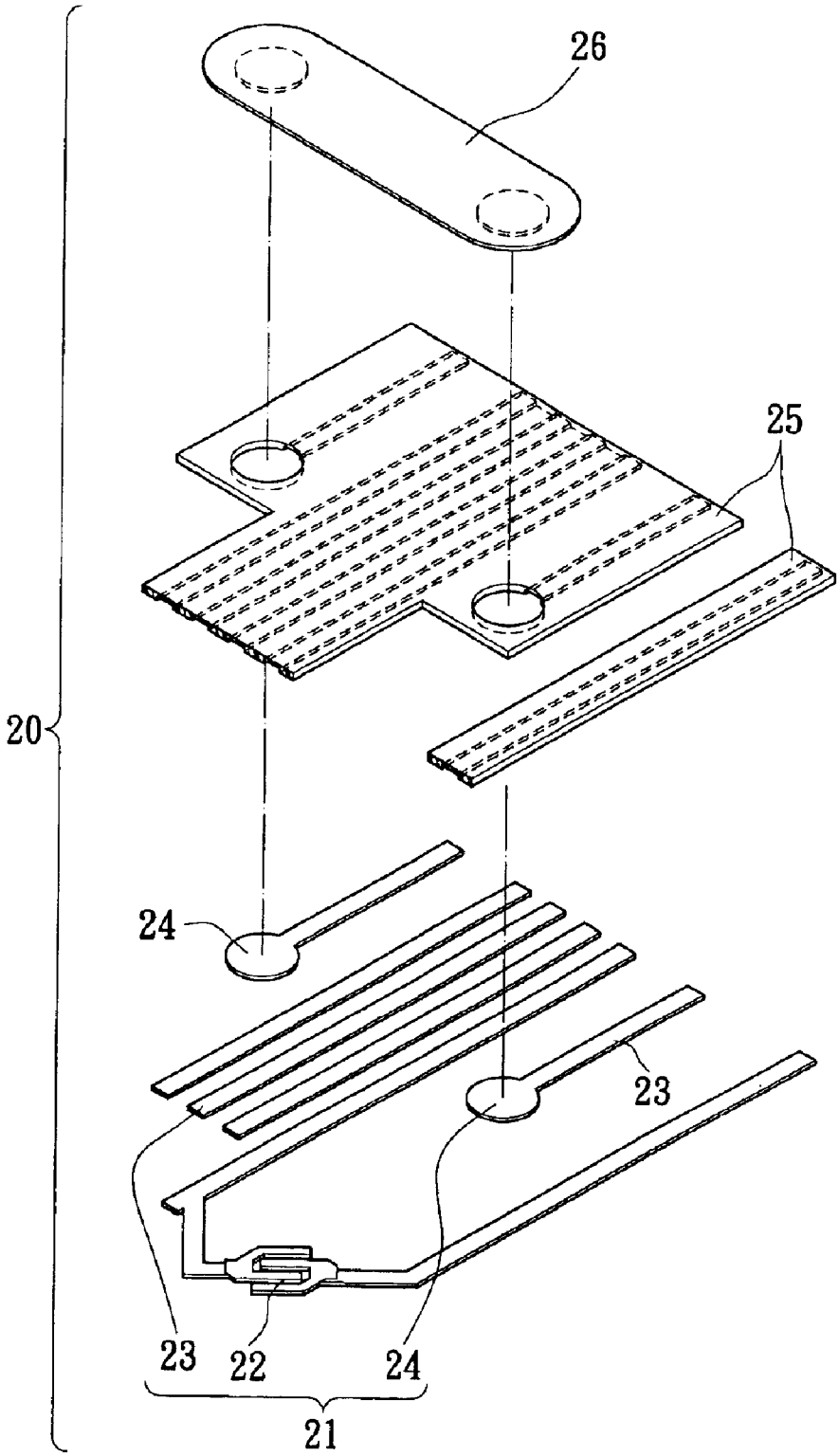
FIG. 4 is an enlarged, exploded view of the printed conducting track unit according to the first embodiment of the present invention.

Referring to FIG. 4 and FIG. 2 again, the bottom shell 10 can be an electrically insulating body molded from polymers. Alternatively, the bottom shell 10 can be made having an electrically insulating top surface. The conducting track unit 20 is a multilayer conducting track unit formed on the top surface of the bottom shell 10 by screen-printing. The formation of the printed conducting track unit 20 includes the steps of: (a) screen-printing a layer of conducting glue, for example, silver glue 21 on the top surface of the bottom shell 10, which layer of silver glue 21 includes contact portions 22, lead wires 23 and conducting portions 24; (b) screen-printing an insulating layer 25 on the top surface of the bottom shell 10 over the lead wires 23 beyond the contact portions 22 and the conducting portions 24; and (c) pain-coating a layer of conducting film, for example, carbon film 26 on the insulating layer 25 over the conducting portions 24 to electrically connect the conducting portions 24.

Referring to FIGS. 2 and 3 again, the top cover 30 covers the bottom shell 10 to carry the press unit 40, having a plurality of through holes 31. The press unit 40 is axially and movably mounted in the through holes 31. A set of rubber domes 51 is provided between the press unit 40 and the printed conducting track unit 20, having conductive contacts 60 respectively mounted in the rubber domes 51 corresponding to and spaced above the contact portions 22 of the printed conducting track unit 20. An IC chip 70 is installed on the top surface of the bottom shell 10, having contact pins 71 electrically connected to the printed conducting track unit 20 by SMD or wire binding. Therefore, pressing the press unit 40 causes the rubber domes 51 to selectively force the conductive contacts 60 into contact with the corresponding contact portions 22 of the conducting track unit 20, thereby driving the IC chip 70 to output a signal.

Figure 5:
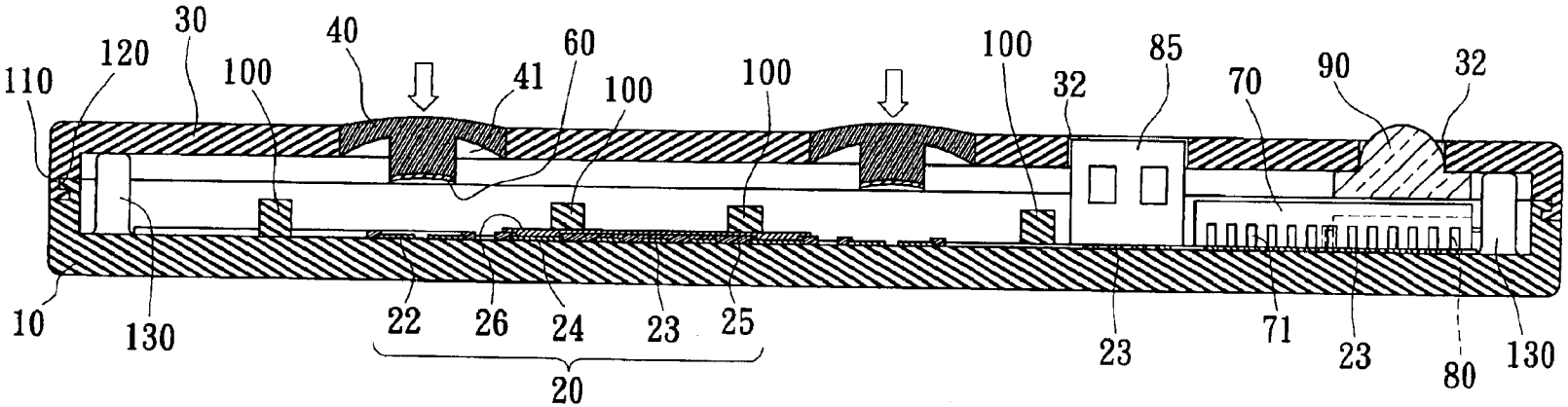
FIG. 5 is a cross-sectional view of a second embodiment of the present invention.

FIG. 5 is a cross-sectional view of a second embodiment of the present invention. According to this embodiment, the press unit 40 is formed in the top cover 30. The press unit 40 can be made flush with the top surface of the top cover 30. Alternatively, the press unit 40 can be made having a top side protruding from the top surface of the top cover 30. Further, the press unit 40 has recessed portions 41 in the bottom side of each button thereof. The bottom shell 10 has a conducting track unit 20 printed on the top surface and an IC chip 70 installed on the top surface and electrically connected to the lead wires 23 of the printed conducting track unit 20. The top cover 30 covers the bottom shell 10. The conductive contacts 60 are respectively located on the bottom side of each button of the press unit 40. The conductive contacts 60 can be a conducting film, for example, carbon film respectively plated on the bottom side of each button of the press unit 40 corresponding to the contact portions 22 of the printed conducting track unit 20. Therefore, pressing the press unit 40 causes the conductive contacts 60 to contact the corresponding contact portions 22 of the printed conducting track unit 20, thereby driving the IC chip 70 to output a signal. This embodiment further comprises a light emitting device, for example, LED (light emitting diode) 80 installed on the top surface of the bottom shell 10 and electrically connected to the lead wires 23 of the printed conducting track unit 20 by SMD. The top cover 30 has through holes 32. A light guide 90 is mounted on the bottom side of the top cover 30 and extended to the inside of one through hole 32 to guide the light of the LED 80. An electric connector 85 is mounted in the bottom shell 20 and electrically connected to the lead wires 23 of the printed conducting track unit 20, having a receiving side positioned in one through hole 32 of the top cover 30 for receiving an external electronic device.

Figure 6:
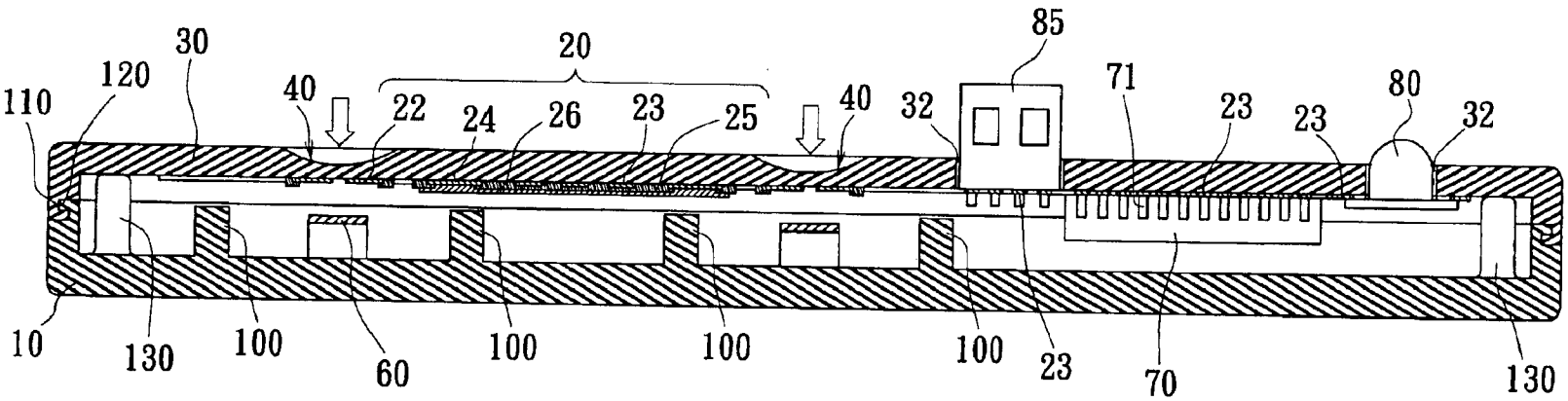
FIG. 6 is a cross-sectional view of a third embodiment of the present invention.

FIG. 6 is a cross-sectional view of a third embodiment of the present invention. According to this embodiment, the top cover 30 is an electrically insulating shell molded from, for example, copolymers. The conducting track unit 20 is printed on the electrically insulating bottom surface of the top cover 30. The electrically insulating bottom surface of the top cover 30 is preferably a planar surface. The press unit 40 is carried on the top cover 30 corresponding to the contact portions 22 of the conducting track unit 20. The IC chip 70 is bonded to the bottom surface of the top cover 30, and electrically connected to the lead wires 23 of the conducting track unit 20. The conductive contacts 60 are located on the top surface of the bottom shell 10. When the top cover 30 covers the bottom shell 20, the conductive contacts 60 are respectively aimed at the contact portions 22 of the conducting track unit 20. Further, the top cover 30 has recessed portions corresponding to the buttons of the press unit 40. Therefore, pressing the press unit 40 cause the press unit 40 to deform slightly and to further force the conductive contacts 60 into contact with the corresponding contact portions 22 of the conducting track unit 20, thereby driving the IC chip 70 to output a signal. When the external force is released from the press unit 40, the top cover 30 returns to its former shape. This embodiment further comprises support means 100 provided between the top cover 30 and the bottom shell 10 to ensure the presence of a gap between the conductive contacts 60 and the contact portions 22 of the conducting track unit 20.

Referring to FIGS. 2, 3, 5 and 6 again, the top cover 30 has through holes 32, and the light emitting device 80 is electrically connected to the printed conducting track unit 20 in the top cover 30 and aimed at or inserted into one through hole 32. As indicated, the light emitting device 80 can be a LED. The top cover 30 has two bottom engagement portions 110 symmetrically disposed on the left and right sides. The bottom shell 10 has two top engagement portions 120 symmetrically disposed on the left and right sides and adapted to engage the bottom engagement portions 110 of the top cover 30. According to the present invention, the bottom engagement portions 110 are retaining grooves, and the top engagement portions 120 are retaining ribs fitting the retaining grooves of the bottom engagement portions 110. The bottoms hell 10 further comprises a plurality of upright bonding portion 130 bonded to the top cover 30.

Figure 7:
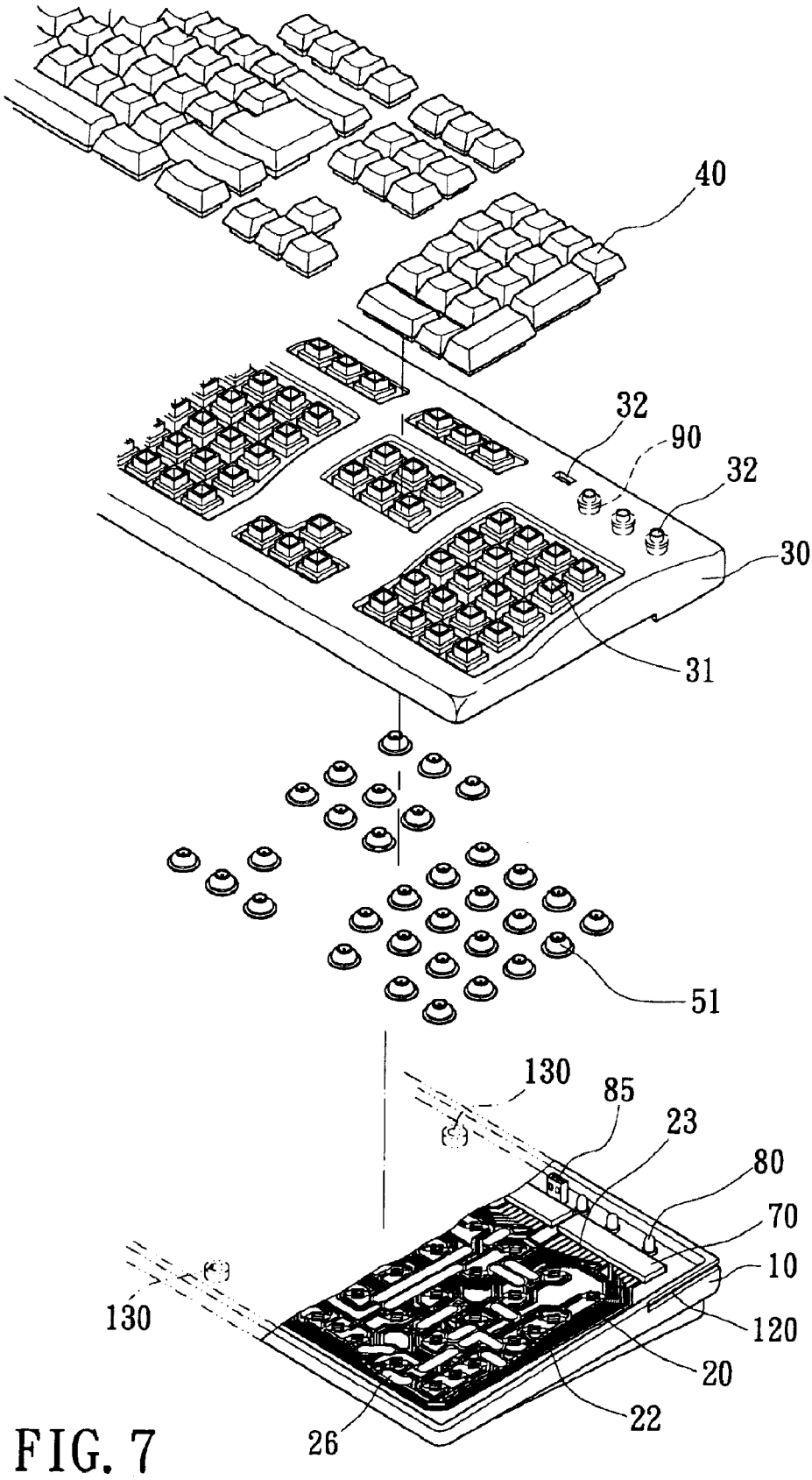
FIG. 7 is an exploded view of a computer keyboard constructed according to the present invention.
Figure 8:
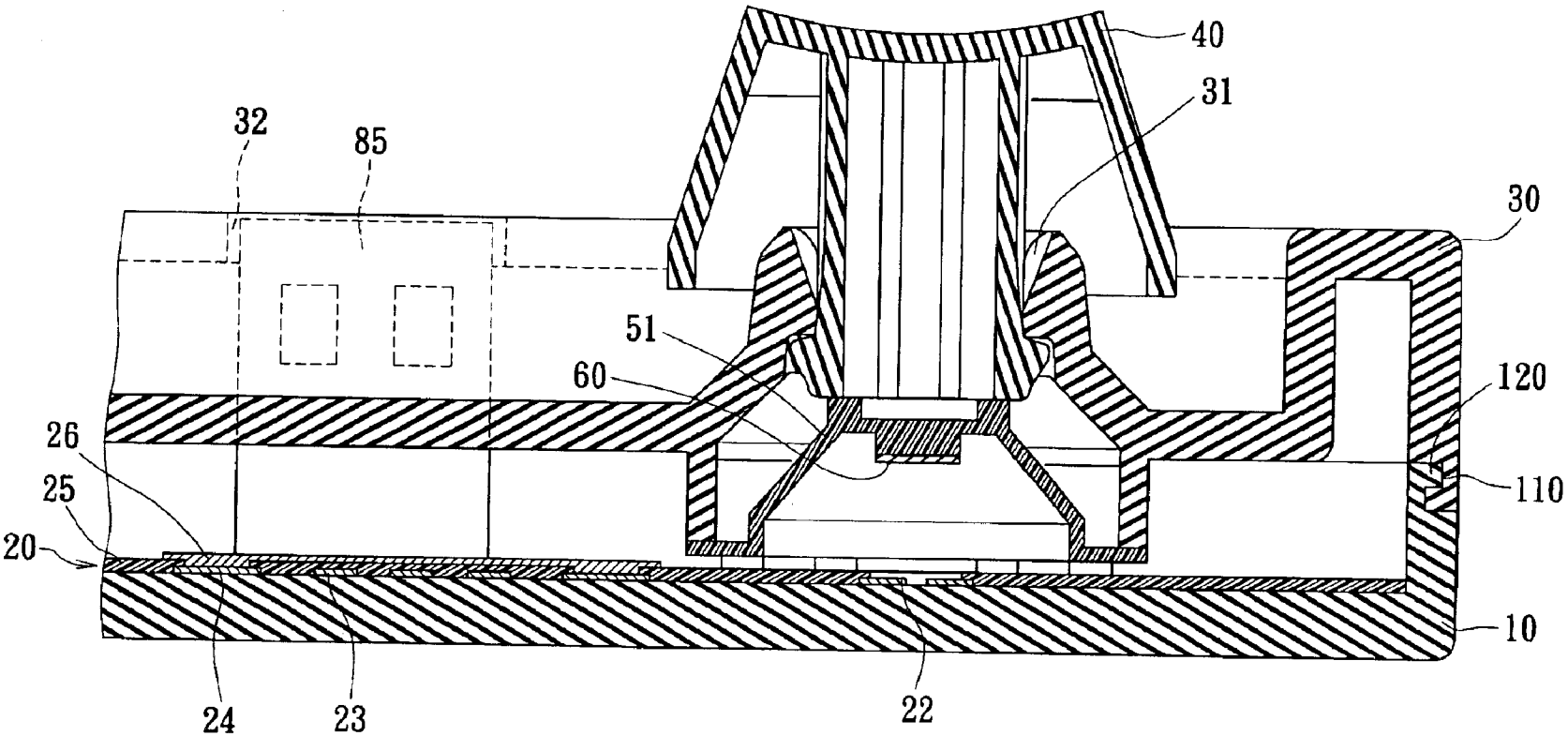
FIG. 8 is an enlarged, cross-sectional assembly view of a part of the computer keyboard shown in FIG. 7.

Referring to FIGS. 7 and 8, the signal input device can be a computer keyboard comprising a bottom shell 10, a printed conducting track unit 20, a top cover 30, rubber domes 51, and conductive contacts 60. The printed conducting track unit 20 is located on the top surface of the bottom shell 10, comprising a plurality of contact portions 22. The top cover 30 covers the bottom shell 10 to carry the press unit 40. The rubber domes 51 are provided between the top cover 30 and the bottom shell 10 corresponding to the contact portions 22 of the printed conducting track unit 20. The conductive contacts 60 are respectively installed in the rubber domes 51 at the bottom side corresponding to the contact portions 22 of the printed conducting track unit 20.

As indicated above, the signal input device has advantages as follows:

1. It can be modularized to ease the fabrication and reduce the manufacturing cost.
2. It requires fewer components, thus reducing material cost.
3. It eliminates many assembly and connection procedures, thereby saving much labor and time.

A prototype of signal input device has been constructed with the features of FIGS. 2–8. The signal input device functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A signal input device comprising:

a bottom shell, said bottom shell having a top surface;

a printed conducting track unit coated on the top surface of said bottom shell, said printed conducting track unit comprising a plurality of contact portions; and a top cover covering said bottom shell, said top cover having a press unit carried in a top surface thereof, said press unit being aimed at and spaced above said contact portions of said printed conducting track unit for pressing by a user to selectively connect said contact portions of said printed conducting track unit.

2. The signal input device as claimed in claim 1, wherein said press unit is formed on the top surface of said top cover and having a recessed portion in a bottom side thereof.

3. The signal input device as claimed in claim 1, wherein the top surface of said bottom shell is electrically insulating.

4. The signal input device as claimed in claim 1, wherein said press unit protrudes over the top surface of said top cover.

5. The signal input device as claimed in claim 1, further comprising a plurality of conductive contacts respectively provided on a bottom side of said press unit corresponding to and spaced above said contact portions of said printed conducting track unit.

6. The signal input device as claimed in claim 1, further comprising a plurality of through holes formed in said top cover and adapted to accommodate said press unit, a plurality of rubber domes supported on the top surface of said bottom shell, and a plurality of conductive contacts respectively mounted in said rubber domes on a bottom side and spaced above said contact portions of said printed conducting track unit for connecting said contact portions of said printed conducting track unit selectively upon pressing of said press unit by the user.

7. The signal input device as claimed in claim 1, wherein said bottom shell comprises an IC chip, said IC chip having contact pins electrically connected to said printed conducting track unit.

8. The signal input device as claimed in claim 1, wherein said bottom shell has a light emitting device mounted therein and electrically connected to said printed conducting track unit.

9. The signal input device as claimed in claim 1, further comprising a light guide mounted in said top cover and extending in one through hole.

10. The signal input device as claimed in claim 1, wherein said top cover comprises two bottom engagement portions disposed at two sides and said bottom shell comprises two top engagement portions disposed at two sides and respectively forced into engagement with the bottom engagement portions of said top cover.

11. The signal input device as claimed in claim 10, wherein said bottom engagement portions of said top cover are retaining grooves.

12. The signal input device as claimed in claim 10, wherein said top engagement portions of said bottom shell are retaining ribs.

13. The signal input device as claimed in claim 1, wherein said bottom shell comprises a plurality of upright bonding portions respectively bonded to said top cover.

14. The signal input device as claimed in claim 1, wherein said printed conducting track unit comprises a layer of conducting glue, said layer of conducting glue comprising conducting portions, said contact portions and a plurality of lead wires, an insulating layer, and a layer of conducting film, said layer of conducting glue being printed on the top surface of said bottom shell, said insulating layer being printed on the top surface of said bottom shell over said lead wires beyond said conducting portions and said contact portions, and said layer of conducting film being printed on said insulating layer over said contact portions to electrically connect said contact portions.

15. The signal input device as claimed in claim 1, further comprising support means provided between said top cover and said bottom shell to keep said conductive contacts separated from said contact portions of said printed conducting track unit by a distance.

16. A signal input device comprising:

a bottom shell, said bottom shell having a top surface;

a plurality of conductive contacts mounted on the top surface of said bottom shell;

a top cover covering said bottom shell, said top cover having a bottom surface and carrying a press unit; and a printed conducting track unit located on the bottom surface of said top cover, said printed conducting track unit comprising a plurality of contact portions respectively aimed at said press unit and separated from said press unit by a distance.

17. The signal input device as claimed in claim 16, further comprising a support means provided between said top cover and said bottom shell to keep said conductive contacts separated from the contact portions of said printed conducting track unit by a distance.

18. The signal input device as claimed in claim 16, wherein said top cover has an IC chip mounted on the bottom surface thereof and electrically connected to said printed conducting track unit.

19. The signal input device as claimed in claim 16, further comprising a light emitting device electrically connected to said printed conducting track unit and aimed at one through hole of said top cover.

20. The signal input device as claimed in claim 16, wherein said top cover comprises two bottom engagement portions disposed at two sides and said bottom shell comprises two top engagement portions disposed at two sides and respectively forced into engagement with the bottom engagement portions of said top cover.

21. The signal input device as claimed in claim 20, wherein said bottom engagement portions of said top cover are retaining grooves.

22. The signal input device as claimed in claim 20, wherein said top engagement portions of said bottom shell are retaining ribs.

23. The signal input device as claimed in claim 16, wherein said bottom shell comprises a plurality of upright bonding portions respectively bonded to said top cover.

24. The signal input device as claimed in claim 16, wherein said printed conducting track unit comprises a layer of conducting glue, said layer of conducting glue comprising conducting portions, said contact portions and a plurality of lead wires, an insulating layer, and a layer of conducting film, said layer of conducting glue being printed on the top surface of said bottom shell, said insulating layer being printed on the top surface of said bottom shell over said lead wires beyond said conducting portions and said contact portions, and said layer of conducting film being printed on said insulating layer over said contact portions to electrically connect said contact portions.

25. The signal input device as claimed in claim 16, wherein the bottom surface of said top cover is electrically insulating.

26. A signal input device comprising:

a bottom shell, said bottom shell having a top surface;

a printed conducting track unit coated on the top surface of said bottom shell, said printed conducting track unit comprising a plurality of contact portions;

a top cover covering said bottom shell, said top cover carrying a press unit;

a plurality of rubber domes provided between said top cover and said bottom shell corresponding to the contact portions of said printed conducting track unit; and a plurality of conductive contacts respectively mounted in said rubber domes on a bottom side and facing the contact portions of said printed conducting track unit.

27. The signal input device as claimed in claim 26, wherein said printed conducting track unit comprises a layer of conducting glue, said layer of conducting glue comprising conducting portions, said contact portions and a plurality of lead wires, an insulating layer, and a layer of conducting film, said layer of conducting glue being printed on the top surface of said bottom shell, said insulating layer being printed on the top surface of said bottom shell over said lead wires beyond said conducting portions and said contact portions, and said layer of conducting film being printed on said insulating layer over said contact portions to electrically connect said contact portions.

28. The signal input device as claimed in claim 26, wherein said bottom shell has a light emitting device bonded to the top surface thereof and electrically connected to said printed conducting track unit.

29. The signal input device as claimed in claim 28, wherein said light emitting device is a light emitting diode.

30. The signal input device as claimed in claim 26, further comprising a liquid guide provided on a bottom side of said top cover and extending to one through hole of said top cover.

31. The signal input device as claimed in claim 26, wherein said bottom shell has an IC chip wire installed on the top surface thereof, said IC chip having contact pins electrically connected to lead wires of said printed conducting track unit.

32. The signal input device as claimed in claim 26 further comprising an electric connector electrically connected to lead wires of said printed conducting track unit and inserted into one through hole of said top cover.

33. The signal input device as claimed in claim 26, wherein said top cover comprises two bottom engagement portions disposed at two sides and said bottom shell comprises two top engagement portions disposed at two sides and respectively forced into engagement with the bottom engagement portions of said top cover.

34. The signal input device as claimed in claim 33 wherein said bottom engagement portions of said top cover are retaining grooves, and said top engagement portions of said bottom shell are retaining ribs respectively engaging said retaining grooves.

35. The signal input device as claimed in claim 26, wherein said bottom shell comprises a plurality of upright bonding portions respectively bonded to said top cover.

36. The signal input device as claimed in claim 26, wherein the top surface of said bottom shell is electrically insulating.

* * * * *